United States Patent [19]

Rosendall

[11] Patent Number: 4,498,207

[45] Date of Patent: Feb. 12, 1985

[54] FLOOR SWEEPER WITH IMPROVED DRIVE WHEEL CONSTRUCTION

[75] Inventor: Henry J. Rosendall, Grand Rapids, Wis.

[73] Assignee: Bissell Inc., Grand Rapids, Mich.

[21] Appl. No.: 510,209

[22] Filed: Jul. 1, 1983

[51] Int. Cl.[3] ..... A47L 11/33

[52] U.S. Cl. ..... 15/42; 15/41 R

[58] Field of Search ..... 15/41–48

[56] References Cited

U.S. PATENT DOCUMENTS

| | | | |
|---|---|---|---|
| 479,200 | 7/1892 | Bedell | 15/41 R |
| 761,836 | 6/1904 | Hodson | 15/41 R |
| 2,082,652 | 6/1937 | Pullen | 15/41 R |
| 2,272,476 | 2/1942 | Parrish | 15/41 R |
| 2,885,700 | 5/1959 | Liddell et al. | 15/45 |

FOREIGN PATENT DOCUMENTS

| | | | |
|---|---|---|---|
| 0056251 | 7/1982 | European Pat. Off. | 15/41 R |
| WO82/02330 | 7/1982 | PCT Int'l Appl. | 15/41 R |

OTHER REFERENCES

International Patent EP0056251, July 1982; WO8202330, July 1982; Patzold et al., Class 15, Sub. 41/R.

*Primary Examiner*—Edward L. Roberts

*Attorney, Agent, or Firm*—Andrus, Sceales, Starke & Sawall

[57] ABSTRACT

A floor sweeper includes a housing sub-frame having a pair of end partitions which mount a brush for sweeping debris from the floor and drive wheels for supporting the sweeper and rotating the brush. The drive wheels are mounted on either side of the brush for free movement between loaded and unloaded positions against a pair of coupling wheels disposed at opposite ends of the brush axle in response to fore and aft translation of the sweeper over the floor. Each drive wheel mounting includes a curved wire spring having a pair of bent legs at opposite ends thereof. One leg is pivotally mounted to the end partition and the other leg rotatably mounts the drive wheel with its free end riding along an inclined ramp formed in the end partition. When the sweeper is moved in one direction the spring is compressed to urge the drive wheel into driving engagement with a coupling wheel to rotate the brush. When moved in the opposite direction, the drive wheel pivots on the one leg of its wire spring away from the coupling wheel to its unloaded position while at the same time the free end of the other leg of the wire spring rides up the ramp to compress the spring and thereby preload or urge the drive wheel back toward the coupling wheel.

12 Claims, 7 Drawing Figures

Fig. 1
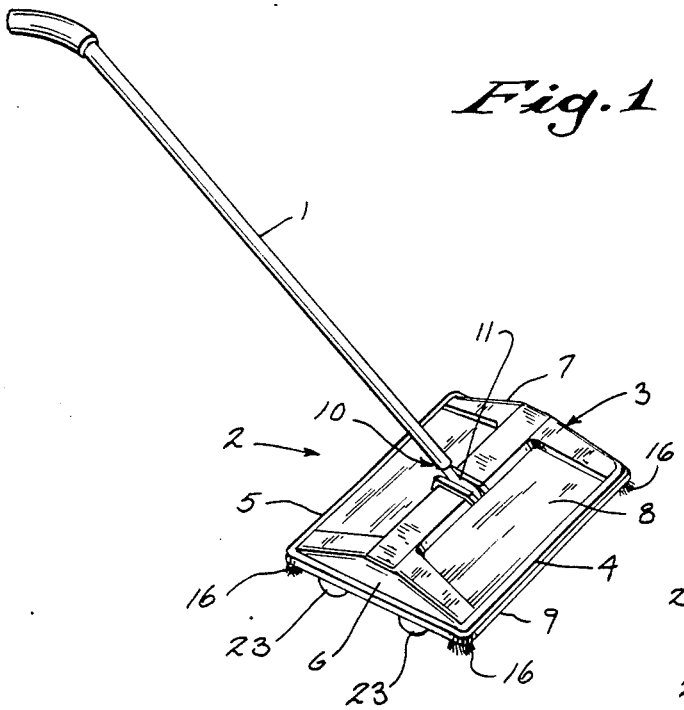
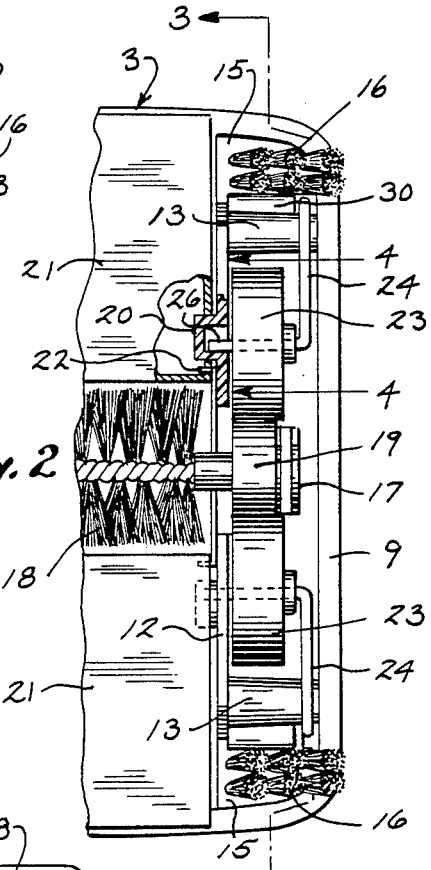
Fig. 2
Fig. 3
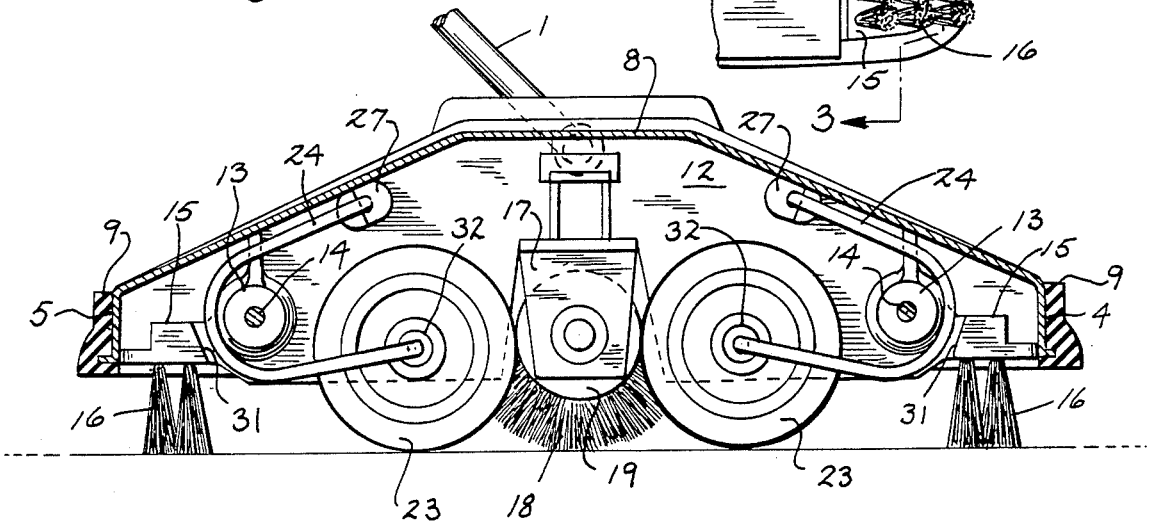

FLOOR SWEEPER WITH IMPROVED DRIVE WHEEL CONSTRUCTION

PRIOR ART OF INTEREST

The following prior art is of interest to the present invention:

| U.S. Pat. No. | Inventor | Issue Date |
|---|---|---|
| 4,168,561 | Rosendall | 1979 |
| 3,268,936 | Fukuba | 1966 |
| 2,082,652 | Pullen | 1937 |

BACKGROUND AND SUMMARY OF THE INVENTION

The present invention relates to floor sweepers, and more particularly to a floor sweeper with an improved drive wheel construction.

It is already known, as shown in the above-identified patents, to construct a floor sweeper to drive a rotatable brush by means of free-floating drive wheels which are disposed in front and in back of a pair of coupling wheels that are located at opposite ends of the brush axle. This free-floating movement is such that when the sweeper is moved in one direction the drive wheels on one side of the brush contact the coupling wheels and rotate the brush by means of the downward pressure of the sweeper on the floor surface. At the same time, the drive wheels on the other side of the brush are moved out of engagement with the coupling wheels by this same pressure. When the sweeper is moved in the opposite direction, the operation of the drive wheels is reversed.

Although the above-identified Rosendall and Pullen patents show the drive wheels mounted on axles extending across the sweeper housing, it is also known from the above-identified Fukuba patent to mount the drive wheels on individual axles which can oscillate back and forth during movement across the floor. Additionally, it is known from the above-identified Pullen patent to provide wire springs which act against the drive wheel axles to urge these wheels toward the brush coupling wheels.

It is a task of the present invention to provide a floor sweeper with an improved drive wheel construction which is simple and economical to manufacture.

It is another task of the invention to provide a drive wheel construction that insures positive "loading" of the drive wheels with the bush coupling wheels when the sweeper is moved in one direction and "unloading" thereof when the sweeper is moved in the opposite direction.

It is a further task of the invention to provide a drive wheel construction which simultaneously "preloads" the drive wheels when moved into their unloaded positions. This preloading eliminates chattering of the drive wheel axles and insures that the drive wheels immediately move to their loaded positions to drive the brush coupling wheels when the direction of sweeper movement is reversed.

In accordance with one aspect of the invention, the sweeper incorporates spring means which pivotally mounts each of the drive wheels with respect to one of the brush coupling wheels for free movement between their loaded and unloaded positions. The spring means also provides an axle for rotatably mounting the drive wheel. The spring means includes a curved wire having a pair of bent legs extending transversely to the curve in the wire and parallel to the brush axle. The curved wire spring thus not only eliminates the need for a common axle for a pair of drive wheels but also loads the drive wheels by urging them into driving engagement with the brush coupling wheels when a downward pressure is applied against the sweeper by a user during movement of the sweeper in one direction over the floor. The pivotal connection of the curved wire spring enables the drive wheels to become unloaded from the coupling wheels when the direction of sweeper movement is reversed by reducing the amount of frictional force applied by the driving wheels against the coupling wheels. When this occurs, the opposite pair of driving wheels, which have now moved to their loaded positions, drive the coupling wheels to rotate the brush in the reverse direction.

In accordance with another aspect of the invention, the free end of the curved wire spring which forms the axle for the drive wheel rides along an inclined surface formed in an end partition of the sweeper sub-frame housing. The inclined surface forms a ramp that functions to preload the drive wheels in the direction of the coupling wheels when the drive wheels are in their unloaded positions by causing the wire spring to be compressed as the drive wheel moves away from the coupling wheel. This ramp insures that the drive wheels immediately move to their loaded positions to drive the coupling wheels upon reversal of the direction of movement of the sweeper. The ramp is inclined at an angle of about 7 degrees so that as the drive wheel moves further away from the coupling wheel a greater preloading force is applied thereto.

BRIEF DESCRIPTION OF THE DRAWINGS

The accompanying drawings furnished herewith illustrate the best mode presently contemplated by the inventor for carrying out the invention.

In the drawings:

FIG. 1 is a perspective view of a floor sweeper embodying the concepts of the invention;

FIG. 2 is a fragmentary bottom plan view of the sweeper with parts broken away for purposes of clarity;

FIG. 3 is an end sectional view taken on line 3—3 of FIG. 2;

DESCRIPTION OF THE PREFERRED EMBODIMENT

Figure 4:
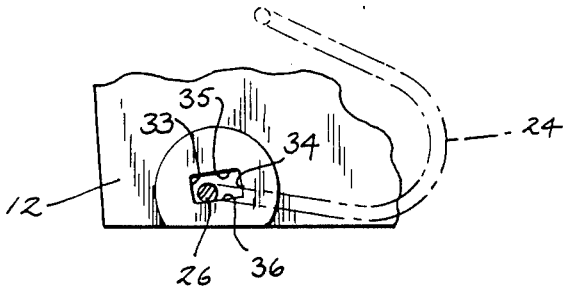
FIG. 4 is a fragmentary end sectional view taken on line 4—4 of FIG. 2.

As shown in the drawings, the floor sweeper of the invention includes a handle 1 and a lower sweeping unit 2. Unit 2 comprises a rectangular unitary housing 3 having front and rear walls 4, 5 end walls 6, 7 and a top 8. A resilient bumper 9 extends around the periphery of housing 3 in the usual manner. Handle 1 is threadedly connected to a bail and stay assembly 10 which extends through an elongated slot 11 in top 8.

Figure 5:
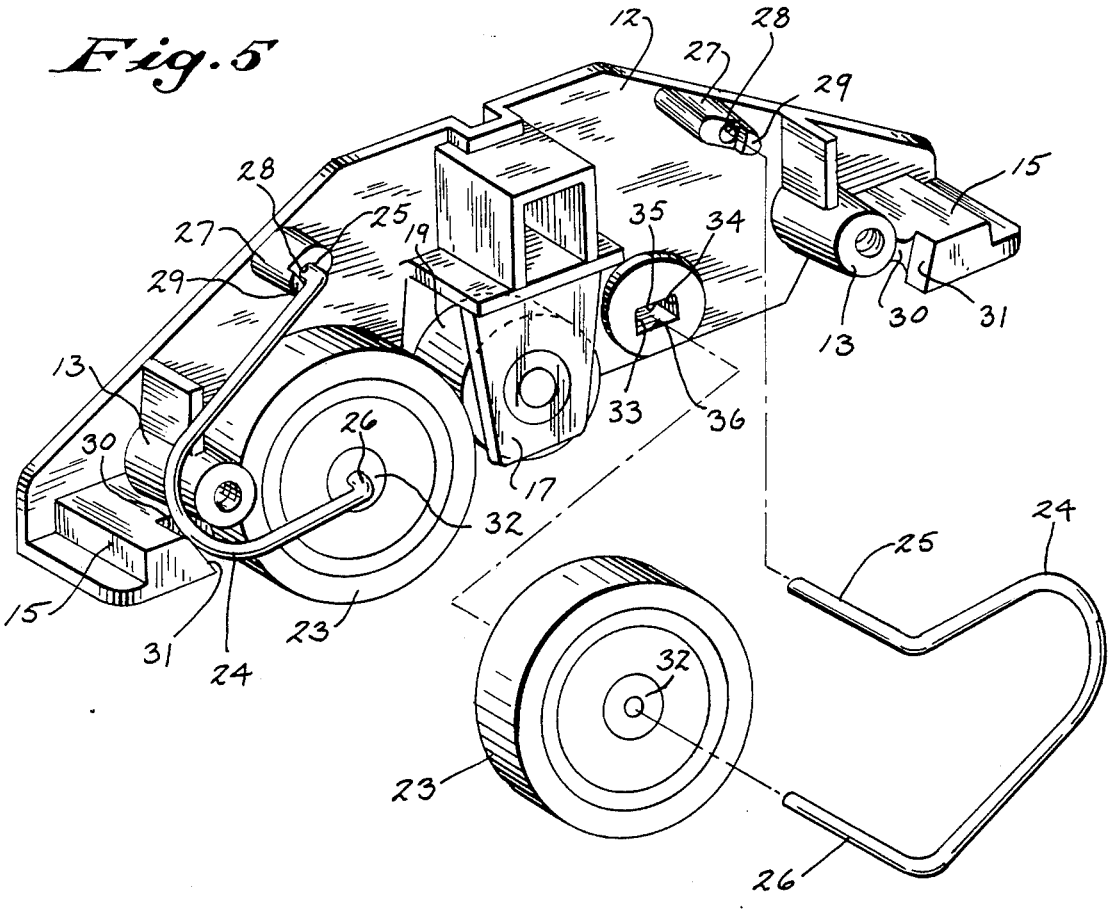
FIG. 5 is an exploded view of the drive wheel construction for the sweeper.

Housing 3 is adapted to mount substantially all of the functional working parts of the sweeper. For this purpose, an end partition 12 is spaced inwardly of each end wall 6, 7 of housing 3 with each member 12 being provided with a pair of outwardly extending sleeve-like spacers 13 to which the housing end walls 6, 7 are secured, as by rivets 14. FIG. 5 shows a detailed view of one partition member 12, the ends of which include flat bases 15 having downwardly depending brushes 16 which are disposed at the sweeper corner (see FIG. 3).

As seen best in FIG. 5, each end partition member 12 has a central outwardly and downwardly extending bracket 17 disposed intermediate its ends. The brackets 17 serve as spacers for the housing end walls 6 and 7, and further serve as the end mounts for a roller brush assembly which includes the usual cylindrical brush 18 and end coupling wheels 19. The bristles of the brush are positioned in the usual manner for contact with the floor for sweeping debris therefrom when brush 18 is rotated during reciprocating fore and aft translation of the sweeper over the floor.

Referring now to FIG. 2, each partition member 12 includes a pair of hollow bosses 20 formed on opposite ends of bracket 17. Bosses 20 project inwardly from the partitions 12 toward the center of the sweeper away from the end walls 6 and 7. Bosses 20 serve as the end mounts for a pair of dust pans 21 which are pivotable thereabout. Pans 21 are biased toward a closed position by a pair of strings 22 extending between the end of pans 21 adjacent the inner sides of partitions 12 and over the brush axle. When it is desired to empty pans 21, pressure is applied along the longitudinal edge adjacent brush 18 so that pans 21 flip open. To close, pressure is applied against the opposite longitudinal edge so that springs 22 cause pans 21 to close.

As shown best in FIG. 2, a pair of drive wheels 23 are disposed on opposite sides of each coupling wheel 19 for supporting the sweeper during reciprocating fore and aft translation over the floor. Drive wheels 23 are located within housing 3 between the partition members 12 and end walls 6 and 7. Drive wheels 23 function to move freely between a loaded position and an unloaded position against coupling wheels 19 in response to the movement of the sweeper over the floor to rotate brush 18 and thereby sweep debris from the floor into dust pans 21. In their loaded positions drive wheels 23 drivingly engage coupling wheels 19, and when unloaded drive wheels 19 merely rotate therewith as will hereinafter be described.

The mounting of drive wheels 23 is shown in FIGS. 3–5. The mounting for each drive wheel 23 includes a curved wire spring having a U-shaped or looped portion 24 and a pair of legs 25 and 26 extending transversely to portion 24. Portion 24 extends parallel to partitions 12 and end walls 6 and 7 and is disposed in a plane substantially perpendicular to the rotation axis of brush 18. Legs 25 and 26 on the other hand both extend to the same side of spring portion 24 and are positioned parallel to one another so that their longitudinal axes are also parallel to the rotation axis of brush 18.

The pivotal connection of upper leg 25 to partition 12 is provided by a hollow stud or sleeve 27 which projects from the outer sides of partitions 12 toward the end walls 6 and 7. Stud 27 includes a central opening 28 formed therethrough for slidably receiving upper leg 25. The diameter of opening 28 is dimensioned to enable leg 25 to freely rotate therein. Stud 27 also includes a stop 29 projecting from its free end along one side thereof which engages spring portion 24 adjacent the bend which forms leg 25. Stop 29 functions to properly locate the spring between partitions 12 and end walls 6 and 7. In order to accommodate the looped end of spring portion 24 a groove 30 is formed between spacers 13 and flat bases 15. Groove 30 includes an inclined face 31 which functions to permit free pivotal movement of spring portion 24 during operation of the sweeper, as will hereinafter be described.

Each drive wheel 23 includes a bearing sleeve 32 which rotatably receives lower leg 26 of the curved spring. As shown best in FIG. 2, the free end of leg 26 is received within hollow boss 20 so that leg 26 serves as an axle which rotatably mounts its respective drive wheel 23. It should be noted that the interior dimensions of boss 20 are larger than the diameter of leg 26 so that drive wheels 23 are freely movable in both horizontal and vertical directions which provides the drive wheels 23 with a "free-floating" function with respect to coupling wheels 19.

Referring now to FIG. 4, the interior of each boss 20 is in the form of a rectangular opening with the front surface 33 and rear surface 34 functioning as stops which provide limited fore and aft movement for drive wheels 23. Top surface 35 and bottom surface 36 also function as stops for limiting the vertical movement of drive wheels 23. Bottom surface 36 is formed at an angle with respect to the bottom edge of partition members 12 and forms an inclined ramp which engages the free end of leg 26. The angle of inclination for surface 36 is about 7° and extends rearwardly and upwardly so that its front end adjacent surface 33 is lower than its rear end adjacent surface 34.

The distance along a straight line between legs 25 and 26 when spring portion 24 is in its unflexed state is approximately equal to the distance between opening 28 in stud 27 and the lower front corner of boss 20 where surfaces 33 and 36 meet. The axles 26 of drive wheels 23 are thus initially located at the lower front corner of the opening of bosses 20. However, as axle or leg 26 rides vertically upwardly along bottom surface 36, spring portion 24 will be compressed to apply a force against its respective drive wheel 23 to urge wheel 23 toward brush coupling wheel 19, i.e. "preload" wheel 23. This "preloading" occurs simultaneously with the "unloading" of wheels 23.

Figure 6:
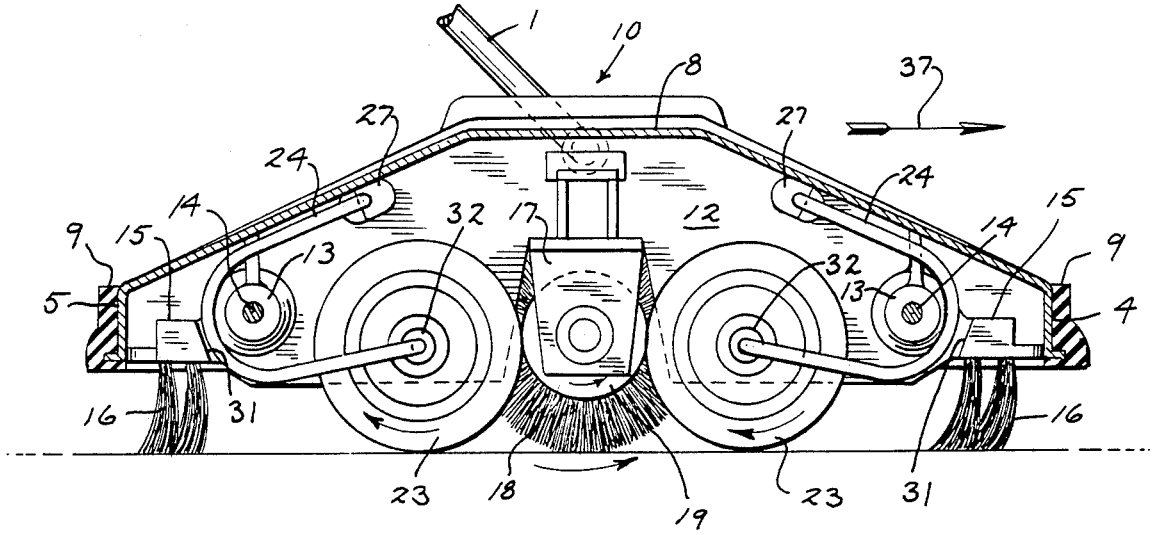
FIG. 6 is an end sectional view similar to FIG. 3 showing the operation of the drive wheels in one direction of movement of the sweeper.

FIG. 3 illustrates the initial operational position for the sweeper with both the lefthand and righthand drive wheels 23 engaging coupling wheels 19. As shown in FIG. 6, when the sweeper is moved over a floor to the right as shown by arrow 37 the righthand drive wheels 23 are in their loaded positions. In these positions, wheels 23 bear against coupling wheels 19 to rotate brush 18 in a counterclockwise direction. The free end of leg 26 moves vertically upwardly within boss 20 adjacent front surface 33 due to the downward pressure applied by a user on the bail and stay assembly 10. This vertical movement of leg 26 compresses the spring portion 24 which applies a force against the righthand drive wheels 23 to urge them to bear against coupling wheels 19 to provide a positive frictional engagement therebetween.

At substantially the same time as the righthand drive wheels 23 are being forced against coupling wheels 19, the frictional force applied by lefthand drive wheels 23 against coupling wheels 19 is reduced due to their free-floating connection within bosses 20, the pivotal connection of spring legs 25, and the friction against the floor. As the lefthand drive wheels 23 are urged to the left in FIG. 6, i.e. to their unloaded positions, the lower legs 26 ride upwardly along the bottom surface 36 in boss 20. As a result of the inclination of surface 36, the wheels 23 are also moved vertically so that the spring portions 24 of their respective spring are compressed to preload the lefthand drive wheels 23. In other words, spring portions 24 apply a force against the lefthand drive wheels 23 which tends to urge them back toward brush 18 so that upon reversal of the movement of the sweeper, the lefthand drive wheels 23 will immediately begin driving coupling wheels 19 and brush 18 in the opposite direction. Note, however, that the frictional force that causes the lefthand wheels 23 to move to the left is greater than the "preload" force which acts to the right so that the lefthand wheels 23, although touching wheels 19, do not drive coupling wheels 19. In their unloaded positions, wheels 23 merely rotate in the direction opposite to that of wheels 19.

Figure 7:
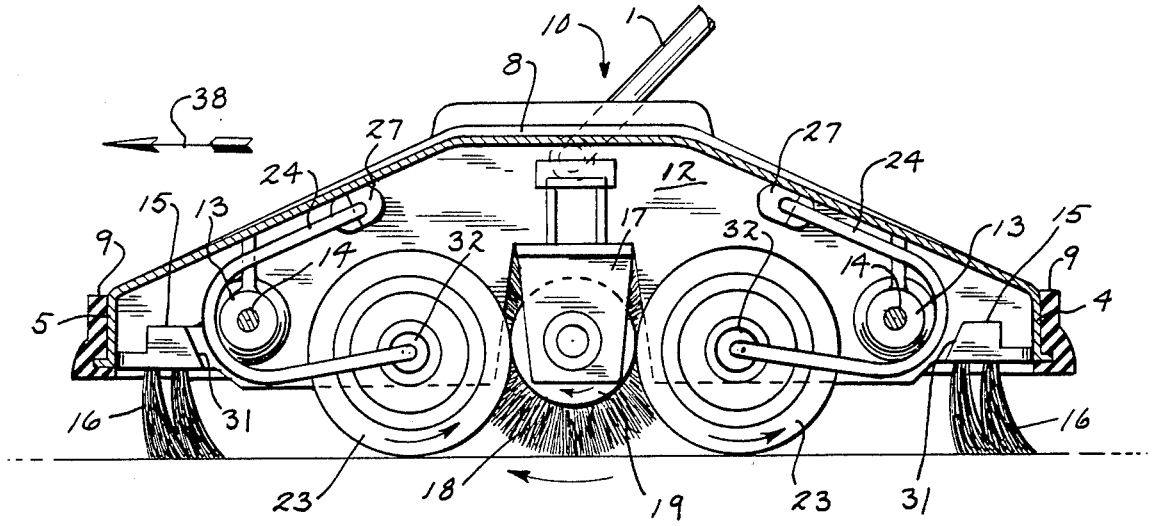
FIG. 7 is an end sectional view similar to FIG. 6 showing the operation of the drive wheels in the opposite direction of movement of the sweeper.

FIG. 7 illustrates the operation of the sweeper when moving to the left in the direction of arrow 38 which is opposite to that shown in FIG. 6. In the direction of FIG. 7, the lefthand drive wheels 23 are loaded or drivingly engaging coupling wheels 19 and rotating brush 18 in a clockwise direction while at the same time the righthand drive wheels 23 are unloaded with respect to coupling wheels 19. In the position shown in FIG. 7, the leg or axle 26 on which the lefthand drive wheels 23 rotate has moved vertically within the interior cavity of boss 20 while leg or axle 26 of the righthand drive wheels 23 has moved rearwardly along bottom surface 36. Again, the lefthand spring portion 24 is compressed to insure positive driving contact of the lefthand drive wheels 23 with coupling wheels 19, and the righthand spring portion 24 is also compressed due to the vertical movement of leg 26 along surface 36 to preload the righthand drive wheels 23.

Upon reversal of movement of the sweeper to once again move in the direction of FIG. 6 the righthand drive wheels 23 immediately begin driving coupling wheels 19. Thus, the curved wire springs are compressed to urge their respective drive wheels 23 toward brush 18 during both fore and aft translation of the sweeper.

Various modes of carrying out the invention are contemplated as being within the scope of the following claims particularly pointing out and distinctly claiming the subject matter which is regarded as the invention.

I claim:

1. In a floor sweeper, the combination comprising:

(a) a housing;

(b) a rotatable brush fixedly mounted on an axle within said housing and with said brush being positioned for contact with the floor for sweeping debris therefrom;

(c) coupling wheels disposed on said axle at opposite end thereof;

(d) horizontally and vertically movable drive wheels disposed within said housing for supporting said sweeper for reciprocating fore and aft translation over the floor, said drive wheels mounted in frictional contact with said coupling wheels for free movement between loaded and unloaded positions in response to said fore and aft translation; and (e) spring means disposed within said housing which acts against said drive wheels to urge said drive wheels into their loaded positions so that they are in driving frictional contact with said coupling wheels to effect rotation of said brush when said sweeper is moved in one direction and acts to effect unloading of said drive wheels when said sweeper is moved in the other direction, said spring means includes a curved spring having horizontally disposed parallel legs at opposite ends thereof extending transversely to the curve in said spring, one of said legs being mounted for pivotal movement about a horizontal axis, and the other of said legs defining an axle for carrying a said drive wheel.

2. The sweeper of claim 1, wherein said spring means further acts to resist the movement of said drive wheels away from said coupling wheels to effect preloading thereof.

3. The sweeper of claim 2, wherein the force applied by said spring means to effect preloading increases in proportion to the increasing distance of said drive wheels from said coupling wheels.

4. The sweeper of claim 3, which includes an inclined ramp along which one end of said spring means travels upon said fore and aft translation.

5. The sweeper of claim 4, wherein said axle is in engagement with said ramp.

6. In a floor sweeper, the combination comprising:

(a) a housing;

(b) horizontally and vertically movable drive wheels disposed within said housing for supporting said sweeper for reciprocating fore and aft translation over the floor, (c) a rotatable brush fixedly mounted on an axle within said housing and with said brush being positioned for contact with the floor for sweeping debris therefrom, (d) coupling wheels disposed on said axle for engagement by said drive wheels, (e) and spring means mounting each of said drive wheels for free movement between loaded and unloaded positions with one of said coupling wheels in response to said fore and aft translation, said spring means having a first end pivotally mounted to said housing and a second end forming an axle which carries a said drive wheel.

7. The floor sweeper of claim 6, wherein said spring means is a curved wire and said other end includes a bent leg extending transversely to the curve in said wire.

8. The floor sweeper of claim 7, wherein said bent leg extends parallel to the axis of said rotatable brush and the curve in said wire extends away from said brush.

9. The floor sweeper of claim 6, wherein said spring means is a curved wire, and said one end and said other end include respective first and second bent legs extending transversely to the curve in said wire.

10. The floor sweeper of claim 9, wherein said first and second bent legs extend to the same side of said curved wire and are parallel to one another.

11. The floor sweeper of claim 10, wherein said housing includes a pair of opposite end walls and a subframe having a pair of partitions spaced inwardly from the respective housing end walls with said brush axle extending therebetween, each partition including a projecting sleeve for receiving said one end of said wire to provide the pivotal connection therefor, and a hollow boss formed therein spaced beneath said sleeve for receiving said other end of said wire therein.

12. The floor sweeper of claim 11, wherein said hollow boss includes a bottom surface which is inclined upwardly and away from said brush.

* * * * *